US006575703B2

(12) United States Patent
Simeone et al.

(10) Patent No.: US 6,575,703 B2
(45) Date of Patent: Jun. 10, 2003

(54) TURBINE DISK SIDE PLATE

(75) Inventors: Peter A. Simeone, Byfield, MA (US); Gary C. Liotta, Beverly, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/910,155

(22) Filed: Jul. 20, 2001

(65) Prior Publication Data

US 2003/0017050 A1 Jan. 23, 2003

(51) Int. Cl.[7] ..... F01D 5/18
(52) U.S. Cl. ..... 416/96 R; 416/97 R; 416/220 R
(58) Field of Search ..... 416/96 R, 95, 416/97 R, 96 A, 220 R, 221; 415/15, 16

(56) References Cited

U.S. PATENT DOCUMENTS

| | | | |
|---|---|---|---|
| 2,928,650 | A | 3/1960 | Hooker et al. |
| 2,988,325 | A | 6/1961 | Dawson |
| 3,832,090 | A | 8/1974 | Matto |
| 3,936,216 | A | 2/1976 | Dixon |
| 3,936,222 | A | 2/1976 | Asplund et al. |
| 4,021,138 | A | 5/1977 | Scalzo et al. |
| 4,086,757 | A | 5/1978 | Karstensen et al. |
| 4,247,257 | A | 1/1981 | Benoist et al. |
| 4,432,555 | A | 2/1984 | Langley |
| 4,435,123 | A | 3/1984 | Levine |
| 4,507,052 | A | 3/1985 | Thompson |
| 4,558,988 | A | 12/1985 | Kisling et al. |
| 4,674,955 | A | 6/1987 | Howe et al. |
| 4,701,105 | A | 10/1987 | Cantor et al. |
| 4,767,276 | A | 8/1988 | Barnes et al. |
| 4,793,772 | A | 12/1988 | Zaehring et al. |
| 4,805,398 | A | 2/1989 | Jourdain et al. |
| 4,820,116 | A | 4/1989 | Hovan et al. |
| 4,822,244 | A | 4/1989 | Maier et al. |
| 4,854,821 | A | 8/1989 | Kernon et al. |

(List continued on next page.)

FOREIGN PATENT DOCUMENTS

| | | |
|---|---|---|
| EP | 0220679 | 5/1987 |
| EP | 1211381 | 6/2002 |

*Primary Examiner*—Edward K. Look
*Assistant Examiner*—James M McAleenan
(74) *Attorney, Agent, or Firm*—William Scott Andes; Steven J. Rosen

(57) ABSTRACT

An annular disk side plate for a gas turbine engine rotor assembly includes an annular plate hub and an annular plate shaft extension extending axially forwardly from the plate hub. A plate web extends radially outwardly from the plate hub and a plate rim extends radially outwardly from the plate web. In the exemplary embodiments of the invention illustrated herein, the plate rim is canted aftwardly from the plate web. One or more annular sealing ridges extend aftwardly from the plate rim. The side plate further includes an anti-rotation means for preventing rotation of the disk side plate relative to the disk such as a circumferential row of radially extending circumferentially spaced apart tabs. Cooling air apertures or holes extend axially through the plate web. A rotor assembly further includes an annular rotor disk comprising a disk hub and an annular disk shaft extension extending axially forward from the disk hub. A disk web extends radially outwardly from the disk hub, a disk rim extends radially outwardly from the disk web, and the disk rim has a forward facing seal face. Rotor blades are mounted in and extend radially outwardly from the disk rim. The annular disk side plate is mounted on an annular forward facing side of the disk and the plate shaft extension is mounted on the disk shaft extension. A pre-loading means for pre-loading the side plate in compression against disk seals the annular sealing ridges against the seal face by axially securing the plate shaft extension to the disk shaft extension.

32 Claims, 6 Drawing Sheets

U.S. PATENT DOCUMENTS 4,872,810 A 10/1989 Brown et al.
4,890,981 A 1/1990 Corsmeier et al.
5,018,943 A 5/1991 Corsmeier et al.
5,135,354 A 8/1992 Novotny
5,143,512 A * 9/1992 Corsmeier et al. ..... 415/115
5,173,024 A 12/1992 Mouchel et al.
5,275,534 A * 1/1994 Cameron et al. ..... 416/95
5,288,210 A * 2/1994 Albrecht et al. ..... 416/198 A
5,310,319 A * 5/1994 Grant et al. ..... 416/220 R
5,330,324 A 7/1994 Agram et al.
5,472,313 A 12/1995 Quinones et al.
5,537,814 A 7/1996 Nastuk et al.
5,597,167 A 1/1997 Snyder et al.
5,622,475 A * 4/1997 Hayner et al. ..... 416/220 R
5,685,158 A 11/1997 Lenahan et al.
5,700,130 A 12/1997 Barbot et al.
5,816,776 A * 10/1998 Chambon et al. ..... 415/175.5
5,951,250 A 9/1999 Suenaga et al.
5,984,636 A 11/1999 Fahndrich et al.
6,067,791 A * 5/2000 Patel ..... 60/39.07
6,077,035 A 6/2000 Walters et al.
6,183,193 B1 2/2001 Glasspoole et al.

* cited by examiner

TURBINE DISK SIDE PLATE

STATEMENT REGARDING FEDERALLY SPONSORED RESEARCH & DEVELOPMENT

The U.S. Government may have certain rights in this invention pursuant to Air Force Contract No. 33615-98-C-2803.

TECHNICAL FIELD

This invention relates to cooling of turbine rotor disks and blades of gas turbine engines with injection of cooling air onto a rotating turbine disk assembly and, in particular, to retention of a disk side plate on the side of a disk of the disk assembly.

BACKGROUND OF THE INVENTION

In gas turbine engines, fuel is burned within a combustion chamber to produce hot gases of combustion. The gases are expanded within a turbine section producing a gas stream across alternating rows of stationary stator vanes and turbine rotor blades to produce usable power. Gas stream temperatures at the initial rows of vanes and blades commonly exceed 2,000 degrees Fahrenheit. Blades and vanes, susceptible to damage by the hot gas stream, are cooled by air compressed upstream within the engine and flowed to the turbine components. One technique for cooling rotating turbine disk assemblies, having blades attached to rims of disks, injects cooling air from stationary cavities within the engine to a disk assembly for distribution to the interior of the turbine blades. A cooling air injection nozzle is a well-known device used to receive compressed air from a compressor of the engine and inject the cooling air through circumferentially spaced passages that impart a swirling movement and directs an injected stream of the cooling air tangentially to the rotating turbine disk assembly. A typical turbine disk assembly has the turbine blades attached to the rims of the disk and a disk side plate attached to a forward or aft face of the disk forming a cooling air passage between the plate and the disk. Circumferentially spaced vanes on the disk side plate that extend radially from a radially inner position on the disk to the radially outer rim and root of the blades may be used to form individual passages between the plate and disk.

The plate also is used to axially retain the blades in dovetail slots in the rim of the disk and to support one or more rotating seals. In order to perform these functions, the disk side plate is usually restrained axially and supported radially by the disk out near the rim or on the web, where the stress fields are typically high. In the case where a disk side plate supports inner and outer rotating seals, or where the outer section of the disk side plate requires more radial support, a means of axial retention and radial support may be required at a lower radially inner position of the disk also. One commonly used disk side plate restraint is a bayonet mount. A bayonet mount design requires an interrupted cut in a bayonet arm of the disk so the disk side plate and disk may mesh and provide axial and radial retention of the plate. These interruptions in the arm, especially in the disk where the hoop and radial stress fields are high, provide 3D stress risers that frequently result in the life limiting areas on both the disk and disk side plate. These 3D features are geometrically complicated and so are also difficult to analyze and life. Even without these interruptions, however, the disk bayonet arm has a fillet that forms an abrupt change in cross-sectional thickness that provides a 2D radial stress riser. Typically, there is also a variable radial rabbet load included in the bayonet feature that complicates the analysis and design. The typical bayonet feature complicates the analysis and design and the typical bayonet arm retention design usually results in a few potential life-limiting locations. In addition to the life limiting concerns, the bayonet feature is typically difficult and expensive to machine. A bayonet arm pocket usually requires special tooling to machine and is difficult to inspect for flaws. This feature is also a common cause of part scraping.

Another low radius disk side plate retention well known in the art is a bolted joint which provides satisfactory part retention, but results in a heavy, bulky configuration with a high parts count. In addition, since bolt sizes don't scale down with engine size, small gas generators usually don't have the space for a joint like this.

SUMMARY OF THE INVENTION

An annular disk side plate includes an annular plate hub and an annular plate shaft extension extending axially forwardly from the plate hub. A plate web extends radially outwardly from the plate hub and a plate rim extends radially outwardly from the plate web. In the exemplary embodiments of the invention illustrated herein, the plate rim is canted aftwardly from the plate web. One or more axially extending annular sealing ridges (in the exemplary embodiment of the invention illustrated herein, there are two sealing ridges) extend aftwardly from the plate rim to seal against a disk with which the plate is designed to mate. An annular groove is disposed a radially inwardly one of the sealing ridges and a sealing ring or sealing wire is disposed within the annular groove to seal against the disk. The side plate further includes an anti-rotation means for preventing rotation of the disk side plate relative to the disk. The anti-rotation means includes elements located on the plate shaft extension which are exemplified by a circumferential row of radially extending circumferentially spaced apart tabs. Cooling air apertures or holes are disposed through the plate web of the side plate and extend axially through the plate web. The disk side plate further includes a radially inner most inner cylindrical surface of the plate shaft extension and an outer cylindrical surface of the plate shaft extension that is spaced radially outwardly of the inner cylindrical surface. The annular disk side plate has a recess extending axially aftwardly into the plate hub and has a radially outer rabbet joint corner. A radially outwardly extending annular ridge is located directly between the plate shaft extension and the recess and traps a sealing wire between the plate shaft extension an annular disk shaft extension of an annular rotor disk.

The present invention includes a rotor assembly with the annular rotor disk comprising a disk hub and the annular disk shaft extension extending axially forward from the disk hub. A disk web extends radially outwardly from the disk hub and a disk rim extends radially outwardly from the disk web. A plurality of rotor blades are mounted in and extend radially outwardly from the disk rim and the disk rim has a forward facing seal face on the disk rim. The annular disk side plate is mounted on an annular forward facing side of the disk and the plate shaft extension is mounted on the disk shaft extension. The cooling air holes disposed through the side plate lead to annular radial passages between the disk side plate and the disk and which conveys cooling air to inlets that lead to the rotor blades. Optionally, cooling plate vanes (not illustrated) on the disk side plate may be used. The cooling plate vanes extend radially outwardly forming circumferentially spaced apart walls of the radial passages. A pre-loading means for pre-loading the side plate in compression against disk seals, the annular sealing ridges against the seal face by axially securing the plate shaft extension to the disk shaft extension.

A first exemplary pre-loading means includes an annular groove in a radially outer surface of the disk shaft extension and a ring disposed in the groove such that the ring axially engages the groove and the plate shaft extension. The ring axially engages an aftwardly facing surface of the groove and axially engages a forwardly facing surface of the plate shaft extension. An exemplary anti-rotation means is disposed on the plate and disk shaft extensions and includes a plurality of first tabs depending radially inwardly from and circumferentially disposed around the plate shaft extension. In the exemplary embodiment illustrated herein, the first tabs depend radially inwardly from a pilot located at a forward end of the plate shaft extension. The anti-rotation means further includes a plurality of second tabs depending radially outwardly from and circumferentially disposed around the disk shaft extension and having first tab spaces between the first tabs and second tab spaces between the second tabs. The first and second tabs are circumferentially interdigitated such that the first tabs are disposed in the second tab spaces and the second tabs are disposed in the first tab spaces. An annular collar member is circumferentially disposed around the plate shaft extension and has a radially inwardly depending flange forming an annular corner around the ring disposed in the groove. A radially outwardly extending annular flange at an aft end of the annular collar member is disposed in the recess forming a rabbet joint with the radially outer rabbet joint corner. In the exemplary embodiment of the invention, the annular collar member is a seal runner having one or more one annular seal lands disposed around the seal runner.

In a second exemplary rotor assembly, the pre-loading means includes the plurality of first tabs depending radially inwardly from and circumferentially disposed around the plate shaft extension and the plurality of second tabs depending radially outwardly from and circumferentially disposed around the disk shaft extension. The first tab spaces are disposed between the first tabs and the second tab spaces are disposed between the second tabs. The first and second tabs are circumferentially aligned and loaded in compression against each other. The anti-rotation means includes a plurality of axially extending third tabs wherein each of the third tabs is disposed in the first and second tab spaces between adjacent ones of the first tabs and between adjacent ones of the second tabs. The anti-rotation means further includes the annular collar member circumferentially disposed around the plate shaft extension and the third tabs depend radially inwardly from the collar member.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
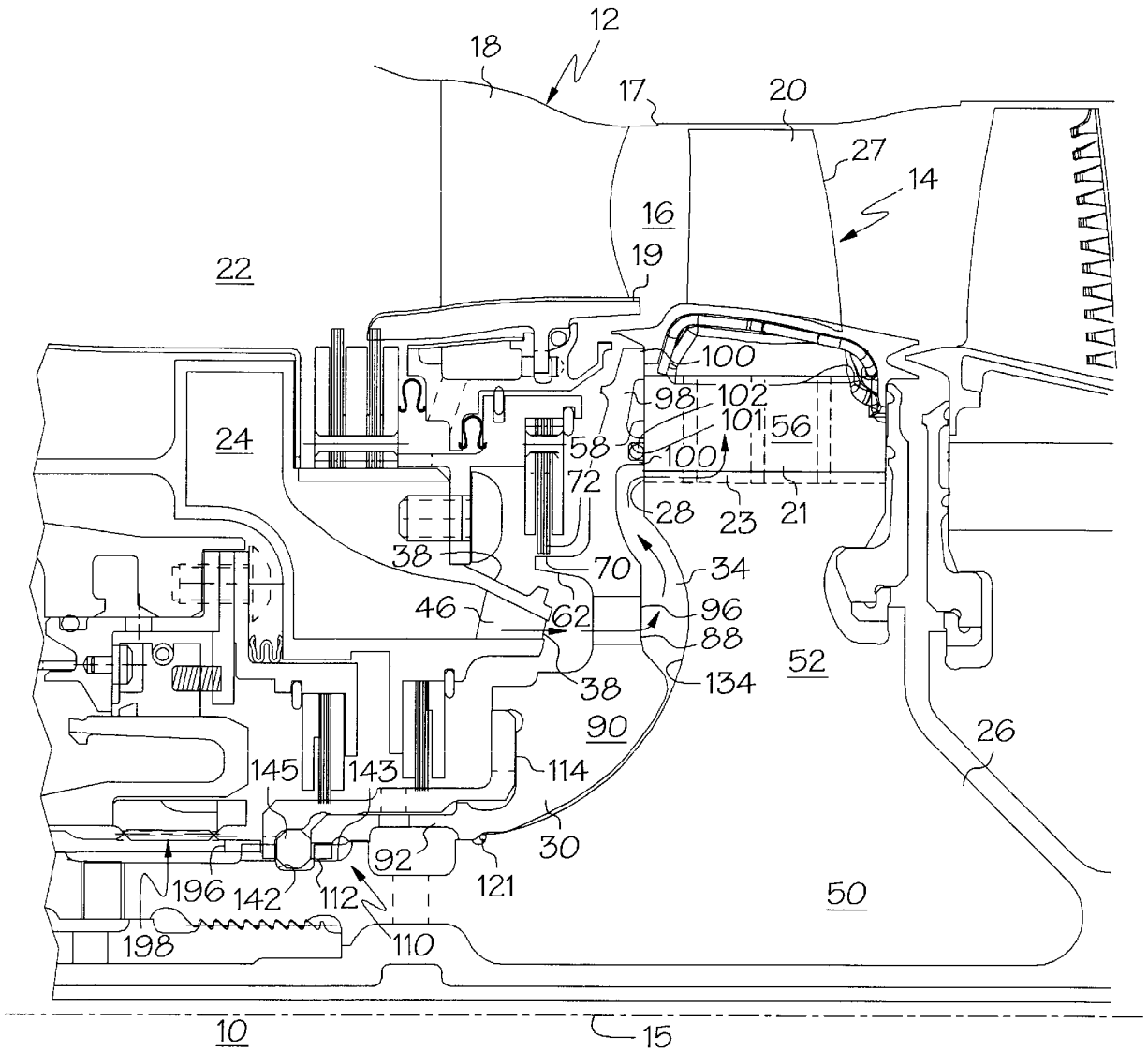
FIG. 1 is a fragmentary axial cross-sectional view illustration of a portion of the turbine section of a gas turbine engine having an exemplary embodiment of a turbine disk assembly of the present invention.

A portion of a turbine section 10 of a gas turbine engine is illustrated in FIG. 1 and includes a stator assembly 12 and a rotor assembly 14 disposed about an engine centerline 15. A flow path 16 for the hot gases is provided downstream of a combustion chamber 22 and defined by the stator assembly 12 including an annular outer flow path wall 17 and an annular inner flow path wall 19. The flow path 16 extends axially between rows of stator vanes 18 and rows of rotor blades 20. An annular cavity 24 is formed within the stator assembly 12 and it functions in part as a reservoir for turbine cooling air. Immediately downstream of the row of stator vanes 18 is disposed the row of rotor blades 20 which extend radially outwardly from a supporting rotor disk 26. The rotor disk 26 has a disk hub 50, an annular disk shaft extension 124 extending axially forward from the disk hub, a disk web 52 extending radially outwardly from the disk hub, and a disk rim 56 extending radially outwardly from the disk web. The rotor blades 20 are mounted in and extend radially outwardly from the disk rim 56. The blades 20 have hollow coolable airfoils 27 extending radially outwardly from respective rotor blade roots 21 which are mounted in the supporting rotor disk 26. The rotor disk 26 includes a plurality of inlets 28, each communicating with internal passages 23 of the roots 21 of the blades 20. During engine operation, cooling air is flowed through the inlets 28, internal passages 23, to the hollow coolable airfoils 27 of the blades 20 to cool the blade 20. An annular disk side plate 30 is mounted on an annular forward facing side 134 of the disk 26 so as to rotate with the disk.

The annular disk side plate 30 includes an annular plate hub 90 and an annular plate shaft extension 92 extending axially forwardly from the plate hub. A plate web 96 extends radially outwardly from the plate hub 90 and a plate rim 98 extends radially outwardly from the plate web. In the exemplary embodiments of the invention illustrated herein, the plate rim 98 is canted aftwardly from the plate web 96. Cooling air apertures (or holes) 88 are disposed through the plate web 96 of the side plate 30 and extend axially through the plate web. The cooling air injection nozzle 38 is used to inject cooling air to the disk in a tangential direction with respect to the rotational direction of the disk. A plurality of circumferentially spaced-apart passages 46 oriented in a tangential angle towards the direction of rotation inject the cooling air from the cavity 24 through the air apertures 88 in the plate web 96 of the side plate 30 into the annular and radial passage 34. One or more annular sealing ridges 100 (in the exemplary embodiment of the invention illustrated herein, there are two sealing ridges 100) extend aftwardly from the plate rim 98. The sealing ridges 100 are designed to seal against a the disk 26 with which the plate 30 is designed to mate. An annular groove 101 is disposed in a radially inwardly one of the sealing ridges 100 and a sealing ring or sealing wire 102 is disposed within the annular groove to seal against the disk 26. The annular sealing ridges 100 seal against a forward facing seal face 58 on the disk rim 56, the radially inwardly sealing ridge using the sealing wire 102 therebetween.

Figure 2:
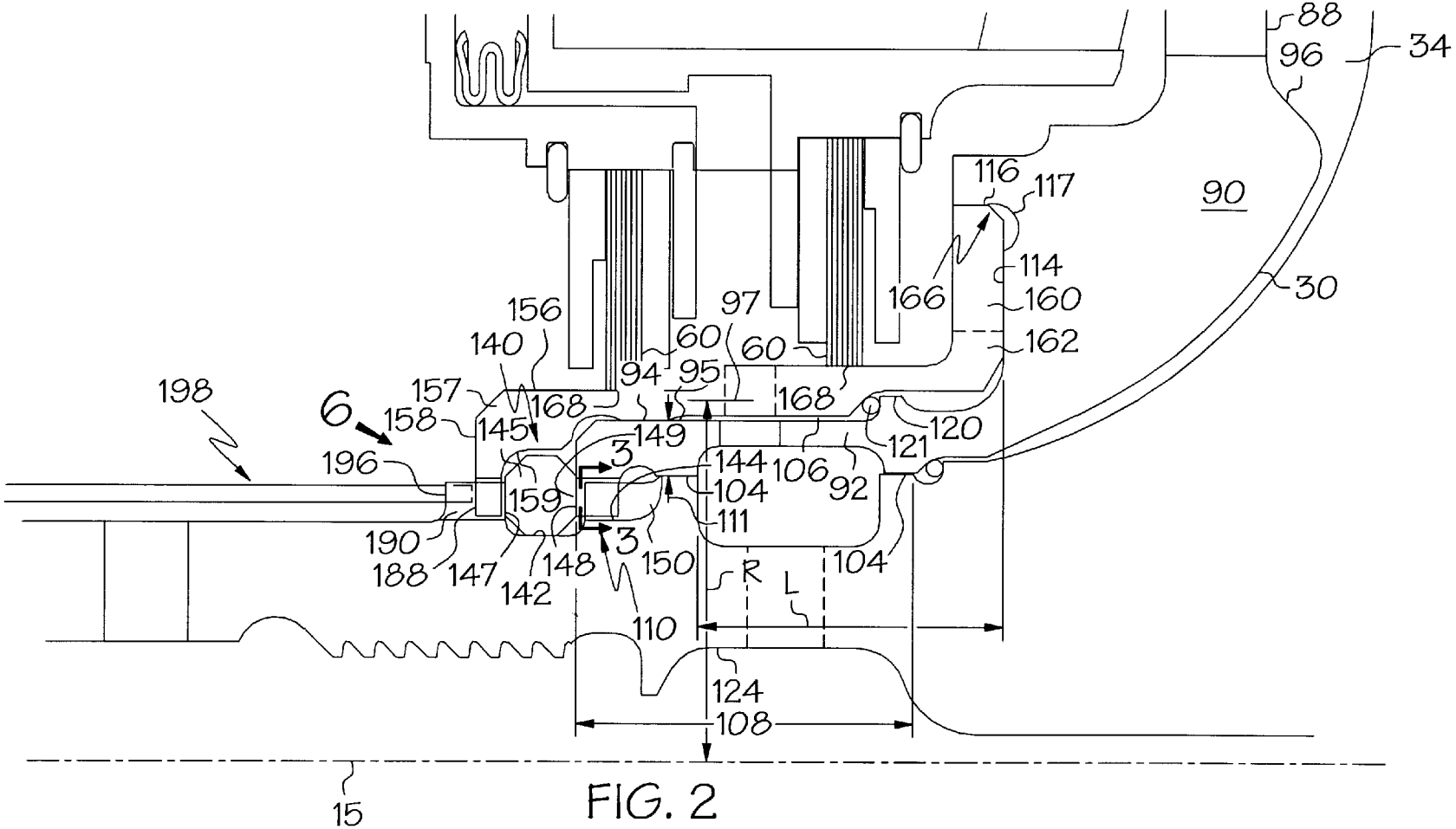
FIG. 2 is an enlarged axial cross-sectional view illustration of a first exemplary embodiment of a means for pre-loading a disk side plate against a disk of the disk assembly in FIG. 1.
Figure 3:
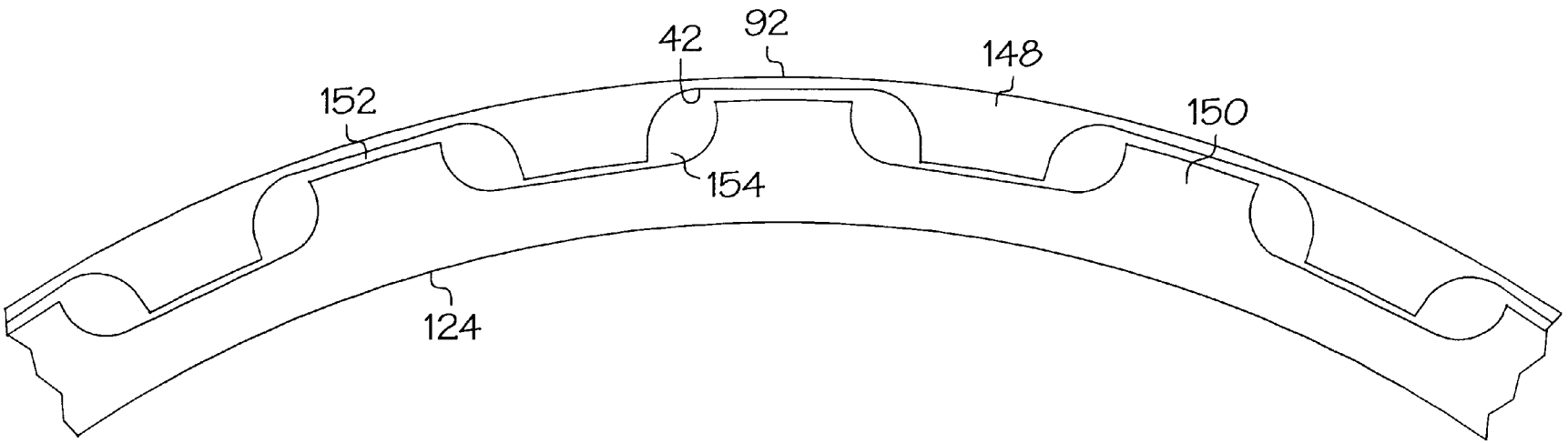
FIG. 3 is a radial cross-sectional view illustration taken along line 3—3 in FIG. 2.

Referring more particularly to FIGS. 2 and 3, the side plate 30 further includes an anti-rotation means 110 for preventing rotation of the disk side plate 30 relative to the disk 26. The anti-rotation means 110 includes elements located on the plate shaft extension 92 which are exemplified by a circumferential row of radially extending circumferentially spaced apart tabs 112. The disk side plate 30 further includes a radially inner most inner cylindrical surface 104 of the plate shaft extension 92 and an outer cylindrical surface 106 of the plate shaft extension that is spaced radially outwardly of the inner cylindrical surface. A pilot 94 is located at a forward end 95 of the plate shaft extension 92. The annular disk side plate 30 has a recess 114 extending axially aftwardly into the plate hub 90 and has a radially outer rabbet joint corner 116 with stress relief fillet 117. A radially outwardly extending annular ridge 120 is located directly between the plate shaft extension 92 and the recess 114.

In the exemplary embodiments illustrated herein, the plate shaft extension 92 has an axial attenuation length L as measured from the plate hub 90 to the pilot 94 and an attenuation radius R measured from the engine centerline 15 to a midline 97 about half way through a shaft wall thickness T of the plate shaft extension 92 between the inner and outer cylindrical surfaces 104 and 106, respectively. In order to attenuate radial growth of the side plate 30, the axial attenuation length L should be about at least equal to 1.25 times the square root of the product of the attenuation radius R and the shaft wall thickness T.

A first exemplary rotor assembly 14 is illustrated in FIGS. 2 and 3 wherein a first exemplary pre-loading means 140 includes an annular groove 142 in a radially outer surface 144 of the disk shaft extension 124 and a split ring 145 disposed in the groove such that the ring axially engages the groove and the plate shaft extension 92. The ring 145 axially engages an aftwardly facing surface 147 of the groove 142 and axially engages a forwardly facing surface 149 of the plate shaft extension 92. When the rotor assembly 14 is assembled, the plate hub 90 is placed in compression against the annular disk side plate 30 and the pre-loading means 140 holds the assembly in compression. The plate shaft extension 92 is pushing or urged against disk shaft extension 124 through the ring 145 and the annular sealing ridges 100 are urged and seal against the forward facing seal face 58 on the disk rim 56. A first exemplary anti-rotation means 110 is disposed on the plate and disk shaft extensions 92, 124 and includes a plurality of first tabs 148 depending radially inwardly from and circumferentially disposed around the plate shaft extension 92. In the exemplary embodiment illustrated.herein, the first tabs 148 depend radially inwardly from the pilot 94. The anti-rotation means 110 further includes a plurality of second tabs 150 depending radially outwardly from and circumferentially disposed around the disk shaft extension 124 and having first tab spaces 152 between the first tabs and second tab spaces 154 between the second tabs. As can be seen more particularly in FIG. 3, the first and second tabs 148, 150 are circumferentially interdigitated such that the first tabs are disposed in the second tab spaces 154 and the second tabs are disposed in the first tab spaces 152 as illustrated in FIG. 3.

Figure 6:
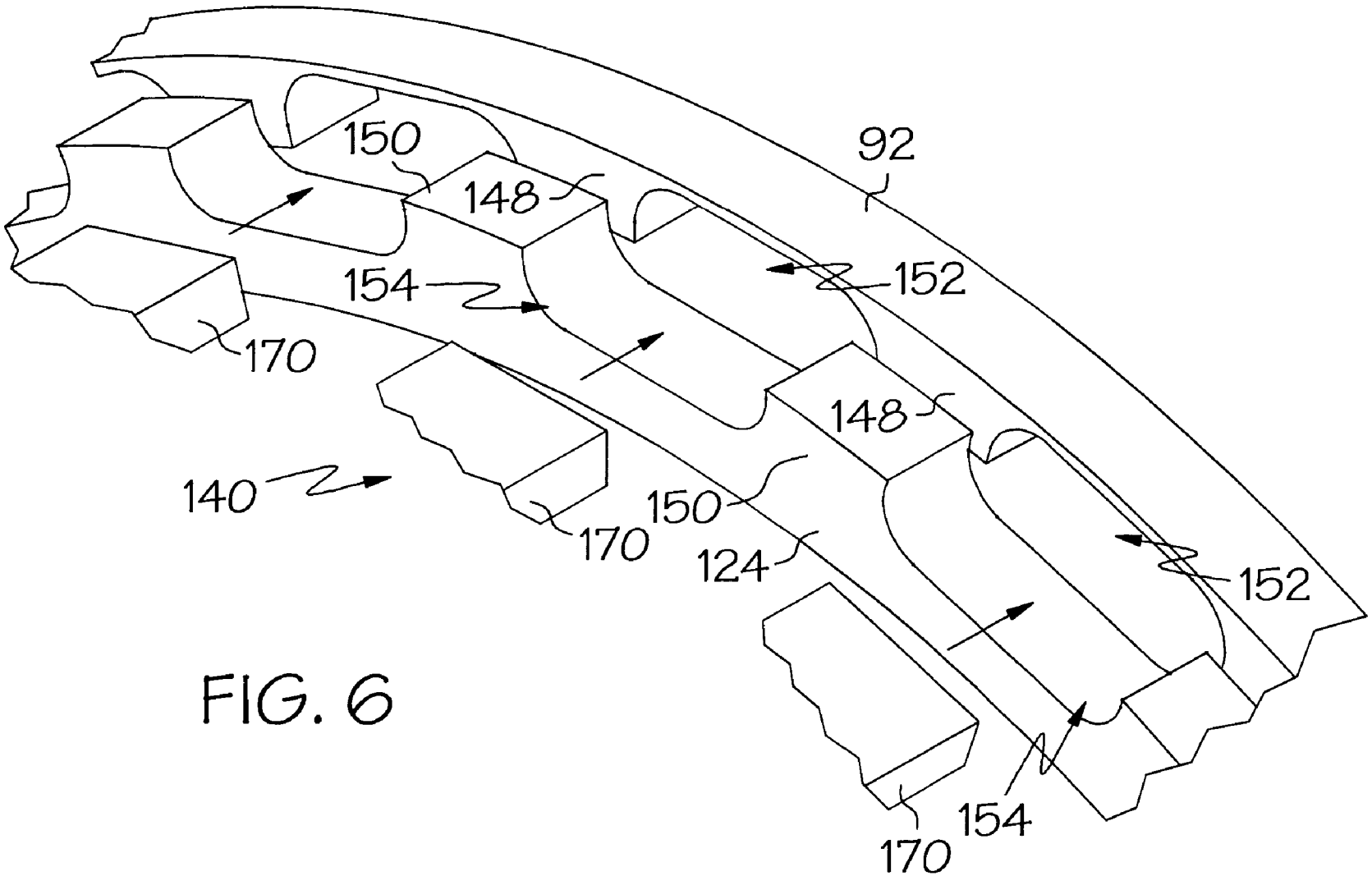
FIG. 6 is a partially exploded perspective view illustration of tabs use for pre-loading and anti-rotation of the disk side plate against a disk of the disk assembly in FIG. 4.

Referring to FIG. 2, an annular collar member 156 is circumferentially disposed around the plate shaft extension 92 and has a radially inwardly depending flange 158 at a forward end 157 of the collar member forming an annular corner 159 around the ring 145 disposed in the groove 142. A radially outwardly extending annular flange 160 at an aft end 162 of the annular collar member 156 is disposed in the recess 114 forming a rabbet joint 166 with the radially outer rabbet joint corner 116. The radially inwardly depending flange 158 includes a plurality of fourth tabs 188 depending radially inwardly from and are circumferentially disposed around the collar member 156. A plurality of fifth tabs 190 extend radially outwardly from and circumferentially disposed around the disk shaft extension 124 axially forward of the second tabs 150. Fourth tab spaces 192 are disposed between the fourth tabs and fifth tab spaces 194 between the fifth tabs 190. The fourth and fifth tabs 188, 190 are circumferentially interdigitated such that the fifth tabs are disposed in the fourth tab spaces 192 and the fourth tabs are disposed in the fifth tab spaces 194 as illustrated in FIG. 6. In the exemplary embodiment of the invention, the annular collar member 156 is a seal runner having one or more one annular seal lands 168 that are disposed around the seal runner and which engage first brush seals 60 located radially inwardly of a cooling air stationary injection nozzle 38. The disk side plate 30 has an annular ledge 62 with an annular seal land 70 which engages second brush seals 72 located radially outwardly of the injection nozzle 38.

The first exemplary rotor assembly 14 is assembled by first aligning the first tabs 148 on the plate shaft extension 92 with the corresponding second tab spaces 154 between the second tabs 150. Assembly tooling is used to overcome assembly axial interference and axially compress the side plate 30 against the rotor disk 26. The split ring 145 is then assembled in the groove 142 such that the ring axially engages the groove and the plate shaft extension 92 and locks the plate hub 90 in compression against the annular disk side plate 30. This also provides axial retention of the plate shaft extension 92 on the disk shaft extension 124. The collar member 156 (the seal runner) is then slid over the plate shaft extension 92 such that the annular flange 160 at the aft end 162 of the annular collar member 156 is disposed in the rabbet joint corner 116 of the recess 114 forming the rabbet joint 166. Anti-rotation of the collar member 156 is provided by the fourth and fifth tabs 188, 190 being circumferentially interdigitated such that the fourth tabs are disposed in the fifth tab spaces 194. The collar member 156 is trapped axially by a part 196 in a higher level rotor or shaft assembly 198.

Figure 4:
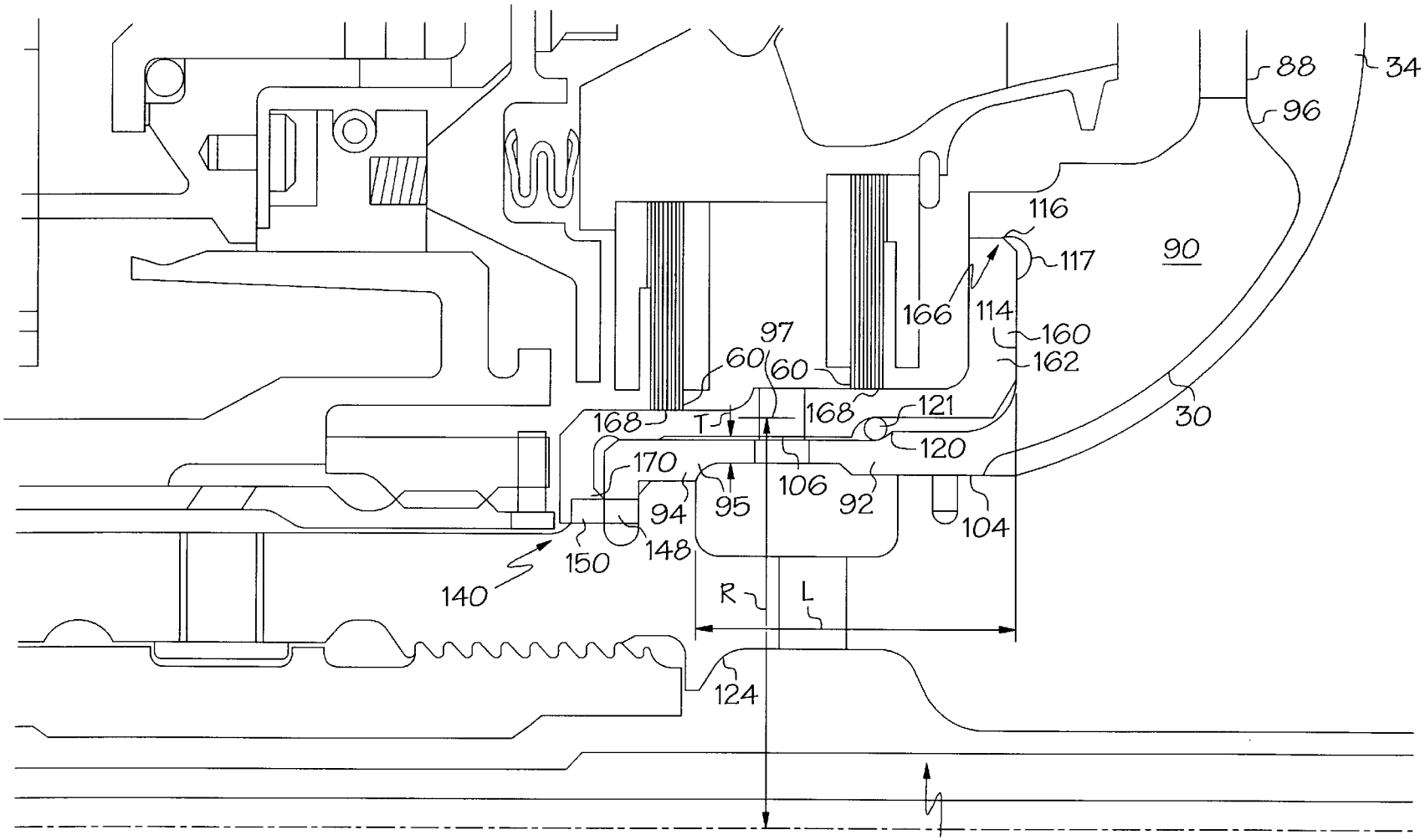
FIG. 4 is an enlarged axial cross-sectional view illustration of a second exemplary embodiment of a means for pre-loading a disk side plate against a disk of the disk assembly in FIG. 1.
Figure 5:
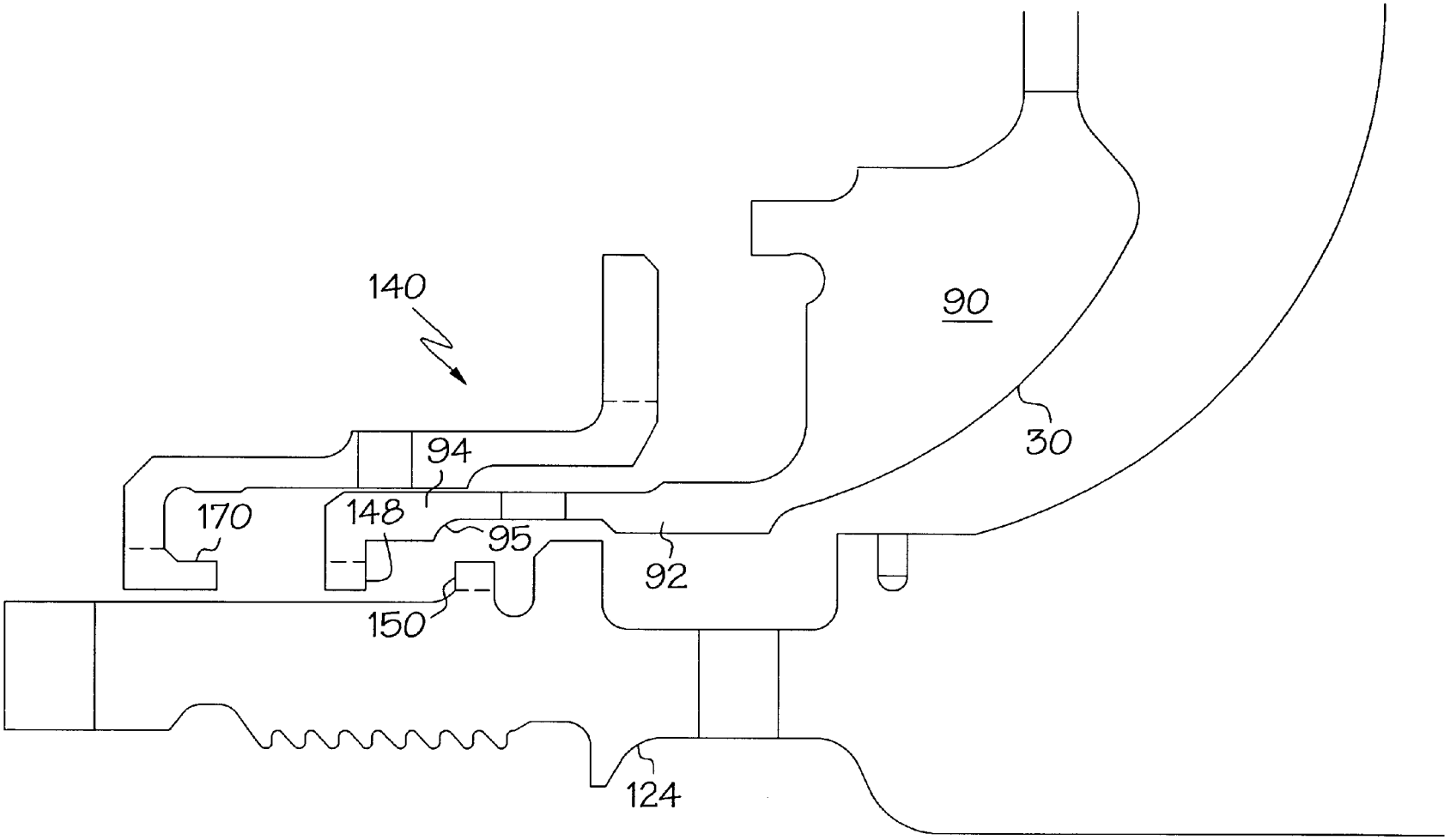
FIG. 5 is an exploded cross-sectional view illustration of the second exemplary embodiment of a means for pre-loading a disk side plate against a disk of the disk assembly in FIG. 4.

Illustrated in FIGS. 4, 5 and 6 is a second exemplary rotor assembly 118 wherein the pre-loading means 140 includes the plurality of first tabs 148 depending radially inwardly from and circumferentially disposed around the plate shaft extension 92 and the plurality of second tabs 150 depending radially outwardly from and circumferentially disposed around the disk shaft extension 124 wherein the first tabs engage the second tabs in an interference fit commonly referred to as a bayonet mount. The first tab spaces 152 are disposed between the first tabs and the second tab spaces 154 are disposed between the second tabs. The first and second tabs 148, 150 are circumferentially aligned and loaded in compression against each other. The anti-rotation means 110 includes a plurality of axially extending third tabs 170 wherein each of the third tabs is disposed in the first and second tab spaces 152, 154 between adjacent ones of the first tabs 148 and between adjacent ones of the second tabs 150, respectively. The anti-rotation means 110 further includes the annular collar member 156 circumferentially disposed around the plate shaft extension 92 and the third tabs depend radially inwardly from the collar member.

The second exemplary rotor assembly 118 is assembled by first aligning the first tabs 148 on the plate shaft extension 92 with the corresponding second tab spaces 154 between the second tabs 150. Assembly tooling is used to overcome assembly axial interference and axially compress the side plate 30 against the rotor disk 26 and with the side plate in compression against the rotor disk 26, the side plate is then rotated to circumferentially align the first and second tabs 148, 150. This loads the first and second tabs in compression against each other, locks the plate hub 90 in compression against the annular disk side plate 30, and provides axial retention of the plate shaft extension 92 on the disk shaft extension 124. The collar member 156 (the seal runner) is then slid over the plate shaft extension 92 such that the annular flange 160 at the aft end 162 of the annular collar member 156 is disposed in the rabbet joint corner 116 of the recess 114 forming the rabbet joint 166 and each of the third tabs is disposed in the first and second tab spaces 152, 154 between adjacent ones of the first tabs 148 and between adjacent ones of the second tabs 150. Anti-rotation of the collar member 156 is provided by the each of the third tabs being disposed in the first and second tab spaces 152, 154. The collar member 156 is trapped axially by a part 196 in a higher level rotor 198.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. An annular disk side plate comprising:

a centerline about which the annular disk side plate is circumscribed, an annular plate hub, an annular plate shaft extension extending axially forward from said plate hub, a plate web extending radially outwardly from said plate hub, a plate rim extending radially outwardly from said plate web, at least one annular sealing ridge extending axially aftwardly from said plate rim, an anti-rotation means for preventing rotation of said side plate, said anti-rotation means located on said plate shaft extension, cooling air holes disposed through and extending axially through said plate web, and a circumferential row of radially extending circumferentially spaced apart tabs.

2. An annular disk side plate as claimed in claim 1, further comprising:

radially inner most inner cylindrical surface of said plate shaft extension, an outer cylindrical surface of said plate shaft extension that is spaced radially outwardly of said inner cylindrical surface, and said plate shaft extension having an axial attenuation length L that is at least equal to 1.25 times the square root of a product of an attenuation radius R measured from a midline about half way through a shaft wall thickness T of said plate shaft extension to said centerline and said shaft wall thickness T.

3. An annular disk side plate as claimed in claim 2 further comprising a recess extending axially aftwardly into said plate hub and having a radially outer rabbet joint corner.

4. An annular disk side plate as claimed in claim 3 further comprising a radially outwardly extending annular ridge located directly between said plate shaft extension and said recess.

5. An annular disk side plate as claimed in claim 4 further comprising two axially aftwardly extending annular sealing ridges.

6. An annular disk side plate as claimed in claim 1, wherein said plate rim is canted aftwardly from said plate web.

7. A rotor assembly comprising:

an annular disk comprising a disk hub, an annular disk shaft extension extending axially forward from said disk hub, a disk web extending radially outwardly from said disk hub, a disk rim extending radially outwardly from said disk web, a plurality of rotor blades mounted in and extending radially outwardly from said disk rim, a forward facing seal face on said disk rim;

an annular disk side plate mounted on an annular forward facing side of said disk, said side plate comprising an annular plate hub, an annular plate shaft extension extending axially forward from said plate hub, a plate web extending radially outwardly from said plate hub, a plate rim extending radially outwardly from said plate web, at least one annular sealing ridge extending aftwardly from said plate rim, an anti-rotation means for preventing rotation of said side plate, and cooling air holes disposed through said side plate;

said plate shaft extension mounted on said disk shaft extension, and a pre-loading means for pre-loading said side plate in compression against disk and sealing said annular sealing ridge against said seal face by axially securing said plate shaft extension to said disk shaft extension.

8. A rotor assembly as claimed in claim 7 wherein said pre-loading means includes an annular groove in a radially outer surface of said disk shaft extension, a ring disposed in said groove, said ring axially engaging said groove and said plate shaft extension.

9. A rotor assembly as claimed in claim 8 wherein said anti-rotation means is disposed on said plate and disk shaft extensions.

10. A rotor assembly as claimed in claim 9 wherein said anti-rotation means includes:

a plurality of first tabs depending radially inwardly from and circumferentially disposed around said plate shaft extension, a plurality of second tabs depending radially outwardly from and circumferentially disposed around said disk shaft extension, first tab spaces between said first tabs, and second tab spaces between said second tabs wherein said first and second tabs are circumferentially interdigitated wherein said first tabs are disposed in said second tab spaces and said second tabs are disposed in said first tab spaces.

11. A rotor assembly as claimed in claim 10 wherein said ring axially engages an aftwardly facing surface of said groove and axially engages a forwardly facing surface of said plate shaft extension.

12. A rotor assembly as claimed in claim 8 further comprising an annular collar member circumferentially disposed around said plate shaft extension and having a radially inwardly depending flange forming an annular corner around said ring disposed in said groove.

13. A rotor assembly as claimed in claim 12 further comprising:

a recess extending axially aftwardly into said plate hub and having a radially outer rabbet joint corner, a radially outwardly extending annular flange at an aft end of said annular collar member, and said radially outwardly extending annular flange disposed in said recess forming a rabbet joint with said radially outer rabbet joint corner.

14. A rotor assembly as claimed in claim 12 wherein said annular collar member is a seal runner having at least one annular seal land disposed around said seal runner.

15. A rotor assembly as claimed in claim 14 wherein said anti-rotation means is disposed on said plate and disk shaft extensions.

16. A rotor assembly as claimed in claim 15 wherein said anti-rotation means includes:

a plurality of -first tabs depending radially inwardly from and circumferentially disposed around said plate shaft extension, a plurality of second tabs depending radially outwardly from and circumferentially disposed around said disk shaft extension, first tab spaces between said first tabs, and second tab spaces between said second tabs wherein said first and second tabs are circumferentially interdigitated wherein said first tabs are disposed in said second tab spaces and said second tabs are disposed in said first tab spaces.

17. A rotor assembly as claimed in claim 16 wherein said ring axially engages an aftwardly facing surface of said groove and axially-engages a forwardly facing surface of said plate shaft extension.

18. A rotor assembly as claimed in claim 7, wherein said plate rim is canted aftwardly from said plate web.

19. A rotor assembly as claimed in claim 18 wherein said pre-loading means includes an annular groove in a radially outer surface of said disk shaft extension, a ring disposed in said groove, said ring axially engaging said groove and said plate shaft extension.

20. A rotor assembly as claimed in claim 19 wherein said anti-rotation means includes:

a plurality of first tabs depending radially inwardly from and circumferentially disposed around said plate shaft extension, a plurality of second tabs depending radially outwardly from and circumferentially disposed around said disk shaft extension, first tab spaces between said first tabs, and second tab spaces between said second tabs wherein said first and second tabs are circumferentially interdigitated wherein said first tabs are disposed in said second tab spaces and said second tabs are disposed in said first tab spaces.

21. A rotor assembly as claimed in claim 20 wherein said ring axially engages an aftwardly facing surface of said groove and axially engages a forwardly facing surface of said plate shaft extension.

22. A rotor assembly as claimed in claim 21 further comprising an annular collar member circumferentially disposed around said plate shaft extension and having a radially inwardly depending flange forming an annular corner around said ring disposed in said groove.

23. A rotor assembly as claimed in claim 22 further comprising:

a recess extending axially aftwardly into said plate hub and having a radially outer rabbet joint corner, a radially outwardly extending annular flange at an aft end of said annular collar member, and said radially outwardly extending annular flange disposed in said recess forming a rabbet joint with said radially outer rabbet joint corner.

24. A rotor assembly as claimed in claim 23 wherein said annular collar member is a seal runner having at least one annular seal land disposed around said seal runner.

25. A rotor assembly as claimed in claim 7 wherein said pre-loading means includes:

a plurality of first tabs depending radially inwardly from and circumferentially disposed around said plate shaft extension, a plurality of second tabs depending radially outwardly from and circumferentially disposed around said disk shaft extension, first tab spaces between said first tabs and second tab spaces between said second tabs, and said first and second tabs and spaces are circumferentially aligned and loaded in compression against each other.

26. A rotor assembly as claimed in claim 25 wherein said anti-rotation means includes a plurality of axially extending third tabs wherein each of said third tabs is disposed in said first and second tab spaces between adjacent ones of said first tabs and between adjacent ones of said second tabs.

27. A rotor assembly as claimed in claim 25 wherein said anti-rotation means further comprises an annular collar member circumferentially disposed around said plate shaft extension and from which said third tabs radially inwardly depend.

28. A rotor assembly as claimed in claim 27 further comprising:

a recess extending axially aftwardly into said plate hub and having a radially outer rabbet joint corner, a radially outwardly extending annular flange at an aft end of said annular collar member, and said radially outwardly extending annular flange disposed in said recess forming a rabbet joint with said radially outer rabbet joint corner.

29. A rotor assembly as claimed in claim 28 wherein said annular collar member is a seal runner having at least one annular seal land disposed around said seal runner.

30. A rotor assembly as claimed in claim 27, wherein said plate rim is canted aftwardly from said plate web.

31. A rotor assembly as claimed in claim 30 further comprising:

a recess extending axially aftwardly into said plate hub and having a radially outer rabbet joint corner, a radially outwardly extending annular flange at an aft end of said annular collar member, and said radially outwardly extending annular flange disposed in said recess forming a rabbet joint with said radially outer rabbet joint corner.

32. A rotor assembly as claimed in claim 31 wherein said annular collar member is a seal runner having at least one annular seal land disposed around said seal runner.

* * * * *